US005813527A

United States Patent [19]

Henrickson

[11] Patent Number: 5,813,527

[45] Date of Patent: Sep. 29, 1998

[54] AIR BLADDER GOLF BAG

[76] Inventor: Danny S. Henrickson, 3475 Rogue River Rd., Belmont, Mich. 49306

[21] Appl. No.: 654,899

[22] Filed: May 29, 1996

[51] Int. Cl.[6] ..... A63B 55/00

[52] U.S. Cl. ..... 206/315.3; 206/315.6; 383/3

[58] Field of Search ..... 206/315.2–315.8; 383/3

[56] References Cited

U.S. PATENT DOCUMENTS

| | | | |
|---|---|---|---|
| 1,494,668 | 5/1924 | Critchlow | 206/315.5 |
| 2,658,543 | 11/1953 | Budnick | 383/3 X |
| 3,777,498 | 12/1973 | Andrews et al. | 383/3 X |
| 3,818,962 | 6/1974 | Muller-Scherak | 383/3 |
| 4,044,867 | 8/1977 | Fisher | 383/3 X |
| 4,155,453 | 5/1979 | Ono | 383/3 X |
| 4,164,970 | 8/1979 | Jordan | 383/3 |
| 4,384,602 | 5/1983 | Ores | 383/3 X |
| 4,402,355 | 9/1983 | Wymore et al. | 206/522 X |
| 4,489,833 | 12/1984 | Bauer | 206/522 |
| 4,503,558 | 3/1985 | Lief et al. | 383/3 |
| 4,569,082 | 2/1986 | Ainsworth et al. | 383/3 |
| 4,574,953 | 3/1986 | Garbuzov | 206/522 |
| 5,141,107 | 8/1992 | Wiedermann et al. | 383/3 X |
| 5,217,131 | 6/1993 | Andrews | 383/3 X |
| 5,240,135 | 8/1993 | Lepinoy | 220/429 |
| 5,419,473 | 5/1995 | Lamar | 206/315.8 X |
| 5,421,454 | 6/1995 | Chern | 206/315.6 |
| 5,458,164 | 10/1995 | Tawil | 141/10 |

FOREIGN PATENT DOCUMENTS

| | | | |
|---|---|---|---|
| 6277315 | 10/1994 | Japan | 248/96 |
| 6315551 | 11/1994 | Japan | 248/96 |
| 704493 | 2/1954 | United Kingdom | 383/3 |

*Primary Examiner*—Sue A. Weaver
*Attorney, Agent, or Firm*—Price, Heneveld, Cooper, Dewitt & Litton

[57] ABSTRACT

A bag which is light in weight and which assumes a relatively rigid structure which maintains its shape during use includes a bladder having opposing lateral edges and a fabric panel having opposing lateral edges which are joined to the opposing lateral edges of the flexible bladder to form an enclosure having a bottom and side walls defined by the flexible bladder and a top defined by the fabric panel. In addition to providing sufficient rigidity, the inflated bladder also provides a cushioned support and enclosure for articles contained therein. The combination of an inflated bladder joined along opposing lateral edges to a fabric panel, in addition to achieving sufficient stiffness and rigidity in a lightweight bag, can be easily fabricated using relatively few components.

18 Claims, 3 Drawing Sheets

AIR BLADDER GOLF BAG

FIELD OF THE INVENTION

This invention generally relates to lightweight bags for transporting and storing articles. A particular application of the invention relates to the provision of a lightweight golf bag.

BACKGROUND OF THE INVENTION

Luggage, cases, and the like, including golf bags, have generally been comprised of relatively rigid materials which define a substantially permanent, rigid structure, or they have been made of flexible fabrics which do not define a rigid structure, but which instead have a shape which is generally defined by the articles stored within the luggage or case. Luggage, cases, and the like, hereinafter collectively referred to as "bags", which are comprised of materials defining a relatively rigid structure have certain disadvantages. Although the relatively rigid bags generally provide superior protection for articles stored therein, and are generally durable, they generally have the disadvantages of being relatively heavy, expensive to make, and cannot be stored in a compact form. Lightweight fabric bags which can be folded into a compact form when empty overcome many of the problems associated with rigid bags. However, known fabric bags which are light in weight do not provide much impact or shock protection for articles stored therein and do not retain any permanent shape or structure, but rather assume a shape generally defined by the articles contained within the bag. For example, lightweight fabric golf bags, which would otherwise be desirable for airline travel and the like, do not provide adequate impact and shock protection for the clubs and other contents during transportation and handling. In order to overcome these deficiencies with conventional lightweight bags, such bags can be provided with metal or other rigid stiffening structures. However, such stiffening structures can add to the weight of the bag, prevent the bag from being collapsible for storage in a compact form, and contact between the clubs or other items stored in the bag and the stiffening structures during shifting of the contents within the bag can cause scuffing and annoying clanging sounds.

Another disadvantage with conventional golf bags is that they cannot be placed on wet ground without risking the possibility of getting the contents of the bag wet and/or causing damage to the bag. For example, in the case of conventional golf bags having an outer leather covering, the leather can become damaged by excessive exposure or contact with moisture. In the case of conventional lightweight golf bags, it is generally difficult to place the bag on wet ground without exposing the club heads to moisture.

A further disadvantage with known golf bags is that they are generally comprised of many parts which add to the cost of materials and labor during fabrication of the bag. As a particular example, most known golf bags have a separately manufactured carrying strap or shoulder strap, as well as a separately manufactured handle which is secured to the body of the bag. The area of the bag at which the shoulder strap and the handle are attached must generally be provided with additional reinforcement which adds to the cost of manufacturing the bag, and the area of the bag at which the shoulder strap is attached must also be provided with a metal ring or other means for fastening the strap to the bag.

In addition to the added expense associated with conventional shoulder straps, such straps are generally relatively flexible and as a consequence a golfer must bend over and reach down essentially to ground level in order to grab the strap and lift the bag if it is place on the ground. Also, known flexible bags which lack rigidity, are sometimes awkward and difficult to strap to a golf cart.

SUMMARY OF THE INVENTION

The invention pertains to a bag which is extremely light in weight, yet exhibits superior rigidity which is comparable to that of conventional, relatively heavy golf bags, without requiring any additional rigid stiffening structures. A further advantage of the bags in accordance with the invention, is that they provide superior protection of the contents of the bag against impact and shock. Golf bags made in accordance with the principles of the invention can be placed on wet ground without risking damage to the bag and without getting the clubs or other contents within the bag wet. All of the above advantages are achieved in a lightweight bag which can be easily collapsed and stored in a compact form.

A bag in accordance with the invention is generally comprised of a flexible bladder and a fabric panel joined to opposing lateral edges of the flexible bladder to form an enclosure having a bottom and side walls defined by the flexible bladder and a top defined by the fabric panel.

In one aspect of the invention, the bag is provided with an integral handle/strap arrangement which allows the bag to be easily carried in the hand or over the shoulder. The integral handle/strap eliminates the need for a separately manufactured strap and reduces and simplifies the reinforcement and fastening means required as compared with conventional bags. Additionally, the integral handle/strap exhibits some rigidity and projects upwardly from the bag when it is placed on the ground so that a golfer does not need to bend over and reach all the way to the ground to lift the bag when it is placed on the ground.

DESCRIPTION OF THE PREFERRED EMBODIMENTS

Figure 1:
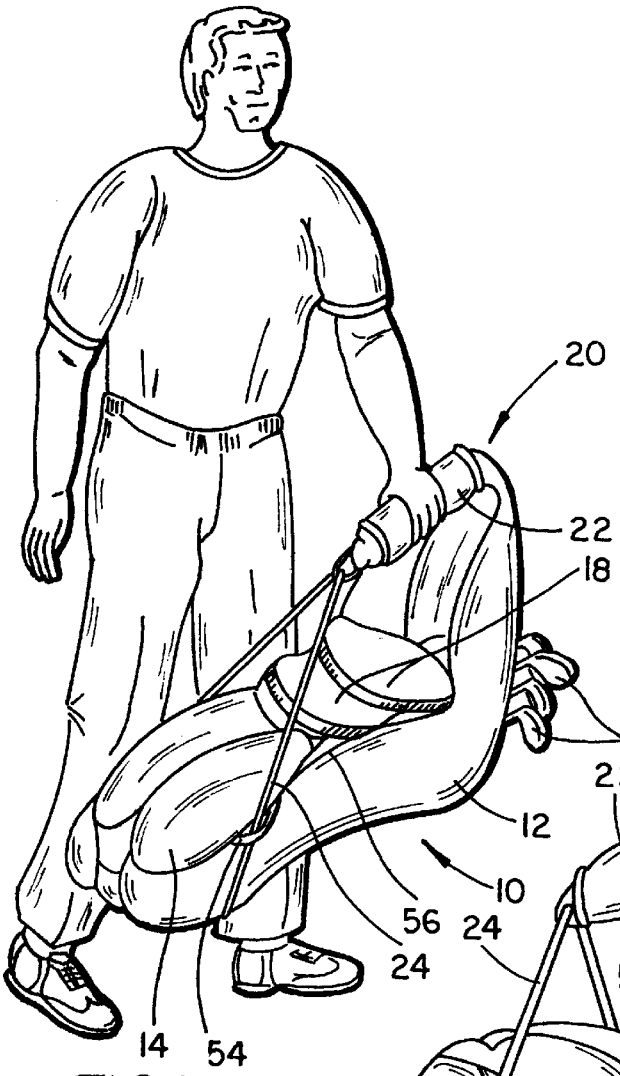
FIG. 1 is a perspective view of a golfer carrying a golf bag which is made in accordance with the principles of the invention.

There is shown, in FIG. 1, a golf bag 10 in accordance with a preferred embodiment of the invention. Golf bag 10 is generally comprised of a bladder 12 which defines the bottom and sides of the bag, and a fabric panel 14 which defines the front of the bag. The fabric panel 14 is desirably provided with a plurality of pockets 18 for storing golf balls, golf tees, and the like. Bladder 12 desirably includes an integral handle/strap 20 having a grip portion 22. Golf bag 10 can either be carried in the hand by grasping grip portion 22, or can be carried over the shoulder by inserting an arm through the loop formed by the integral handle 20 and strap 24, and by positioning the grip portion 22 on the shoulder.

Figure 2:
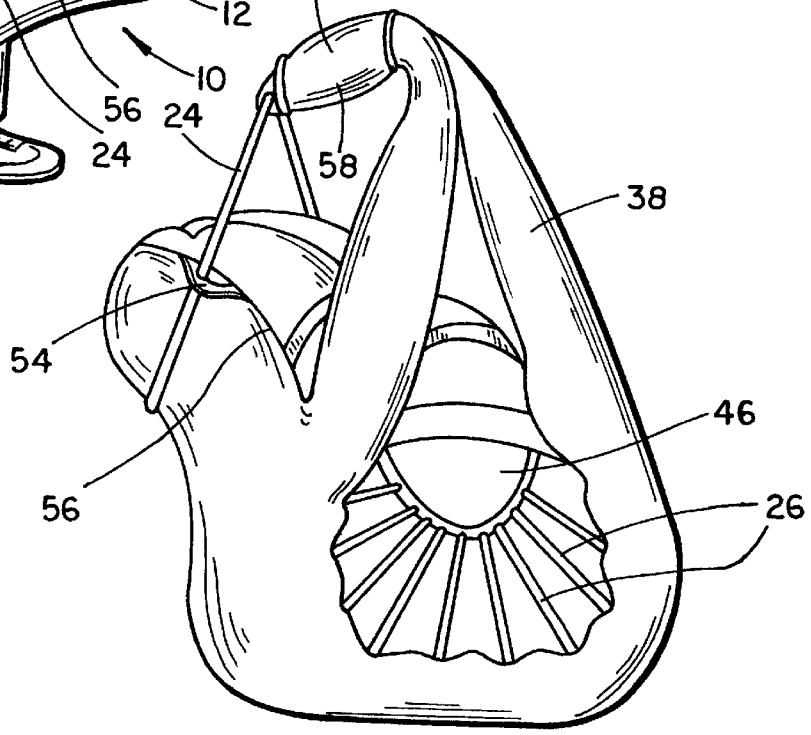
FIG. 2 is a top, front perspective view of the golf bag shown in FIG. 1.

With reference to FIG. 2, golf bag 10 is desirably provided with club dividers 26 so that golf clubs 28 can be conventionally stored separately in an organized manner.

Figure 3:
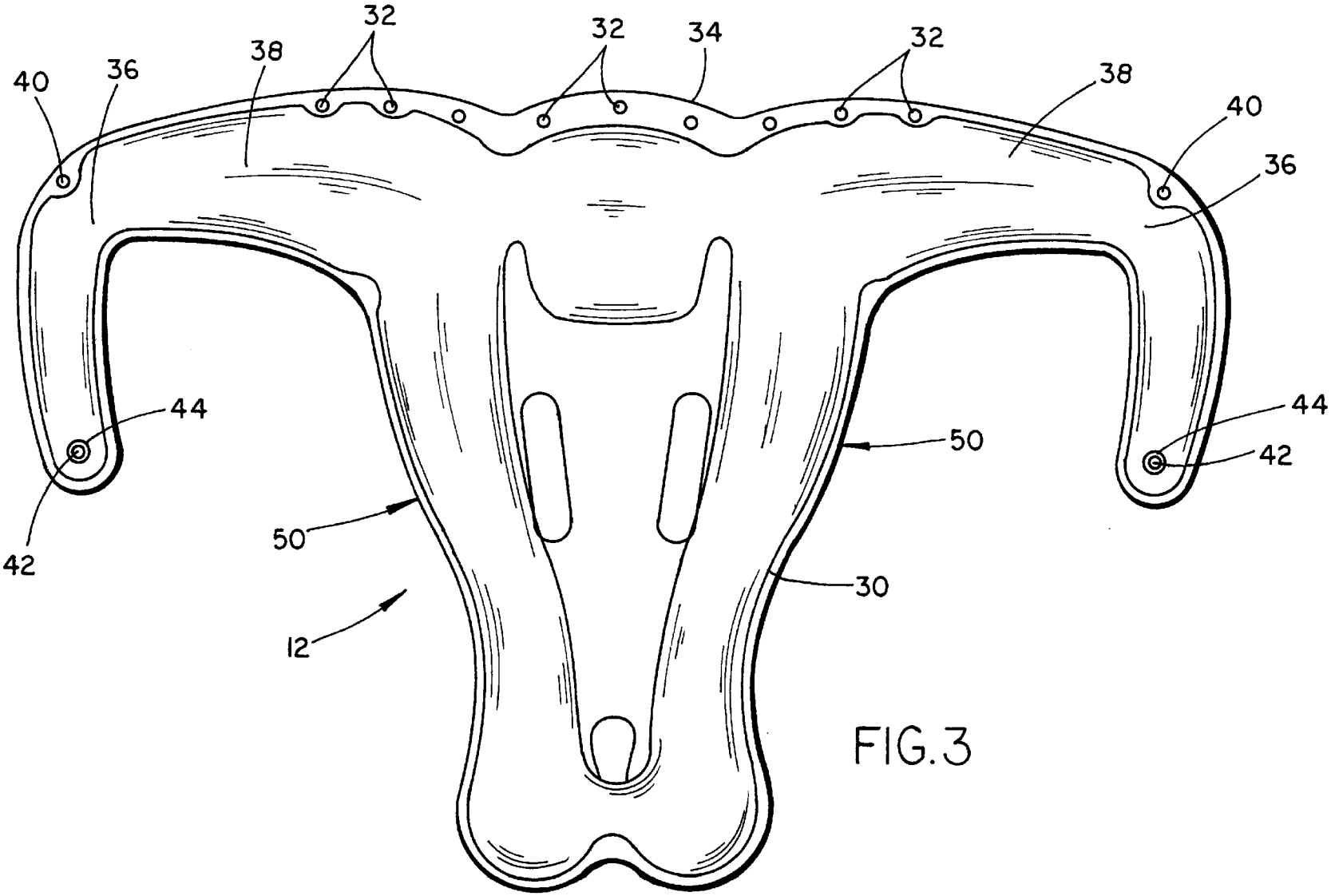
FIG. 3 is a top plan view of a bladder used to form the bottom and sides of the golf bag shown in FIGS. 1 and 2.

Bladder 12 is generally comprised of two air-impermeable fabric sheets, each of which is cut into a substantially identical pattern, as shown in FIG. 3. Suitable air-impermeable fabrics are generally well known to the art and do not need to be described in detail. However, preferred air-impermeable fabrics are flexible and elastically stretchable. Bladder 12 is formed by superimposing one sheet of an air-impermeable fabric which is cut into the pattern shown in FIG. 3 over a second sheet of air-impermeable material which is cut into a substantially identical pattern. The two sheets of air-impermeable fabric are then joined together near the periphery of the overlapping sheets to form an air-impermeable seam 30. Any of various conventional means can be employed for forming air-impermeable seam 30. However, preferred methods for forming air-impermeable seam 30 include various fusion techniques wherein the joined edges of the two air-impermeable sheets are fused together at a molecular level to form a substantially continuous air-impermeable bladder. Such techniques include ultrasonic welding and other thermal fusing techniques.

The upper edge of the bladder 12 is desirably provided with a plurality of apertures 32 which are located between the seam 30 and the peripheral edge 34 of the bladder, so that club divider 26 can be strung between bladder 12 and fabric panel 14. Bladder 12 desirable includes wing portions 36 which project laterally outwardly from the central portion of the bladder to provide an integral handle 20. More specifically, wing portions 36 each include a first section 38 which projects laterally outwardly from the main or central portion of the bladder and a grip portion 22 which extends downwardly at a substantially right angle from the end of section 38. Each of the grip portions 22 includes a first aperture 40 located generally at the juncture between section 38 and grip portion 22, and between the seam 30 and the peripheral edge 34; and a second aperture 42 which is located at the opposite end of grip portion 22. Aperture 42 is located within an area bounded by the peripheral seam 30, and is also circumscribed by a circular, air-impermeable seam 44, which is preferably formed by a fusion technique such as ultrasonic welding. Apertures 32, 40 and 42 may be provided with metal or plastic reinforcing grommets if desired.

Figure 4:
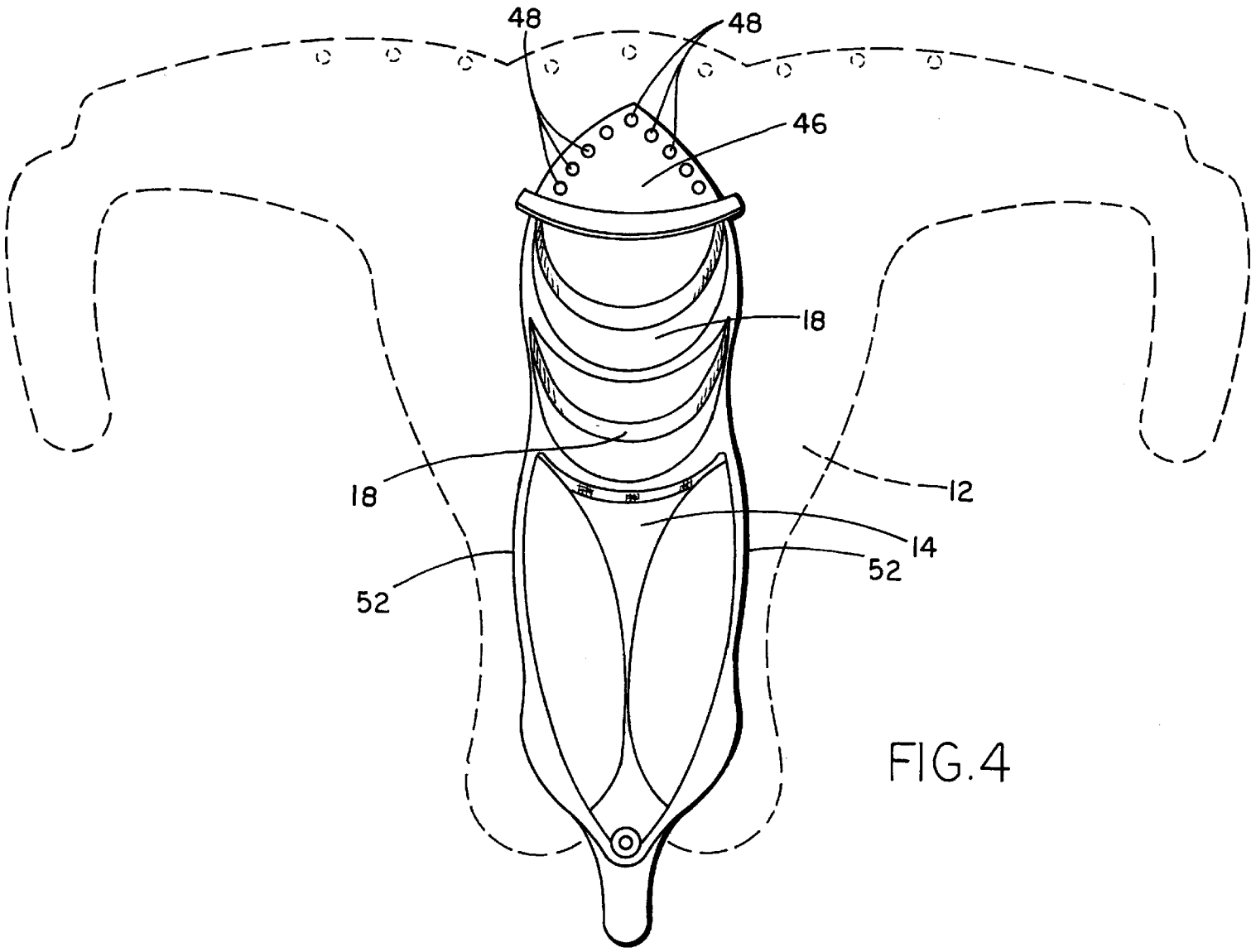
FIG. 4 is a top plan view of the assembled golf bag shown in FIGS. 1 and 2 superimposed on a fantom view of the bladder shown in FIG. 3, to help illustrate the manner in which the golf bag is assembled.

The front fabric panel 14, which is best illustrated in FIG. 4, is configured, i.e. sized and shaped, to form the top or front of the bag 10. Panel 14 can also be a bladder, but is preferably formed of a sheet of durable, lightweight fabric such as nylon. Panel 14 is preferably provided with one or more pockets 18 for storing various small articles. The upper end of panel 14 includes a generally triangular shaped flap 46 having a plurality of apertures 48 which are generally located adjacent the upper or outer edges of the flap 46. Each of apertures 48 correspond with one of the apertures 32 located along the upper edge of bladder 12. Apertures 32 and 48 are used for stringing a club divider as shown in FIG. 2.

With reference to FIGS. 3 and 4, golf bag 10 is formed by joining the opposing lateral edges 50 of bladder 12 to opposing lateral edges 52 of panel 14 to form an enclosure having a bottom and sides defined by the flexible bladder and a top defined by the fabric panel. Fabric panel 14 can be joined to bladder 12 using any of a variety of suitable techniques, such as sewing or stitching the lateral edges 50 to lateral edges 52.

After panel 14 has been joined to bladder 12, as set forth above, assembly is completed by attaching grip portions 22 together, strapping grip portions 22 to bag 10 such as by stringing strap 24 through grip portions 22, through strap loops 54, and around the sides and bottom of bag 10, securing the opposing ends of strap 24 together to form a continuous loop, and attaching club divider or dividers 26 to apertures 32 and 48. Strap loops 54, which are generally located at the juncture or seam 56 between the opposing lateral edges 50 and 52, respectively, can be sewn or otherwise attached to the opposing lateral edges 50 of bladder 12 or the opposing lateral edges 52 of panel 14 before panel 14 is secured to bladder 12, or strap loops 54 can be sewn or stitched to seam 56 in a single operation as panel 14 is being joined to bladder 12. Club dividers 26 can be comprised of a plurality of individual members which are secured at one end to one of the apertures 32 of bladder 12 and at the other end to a corresponding aperture 48 on flap 46. Alternatively, dividers 26 can be formed by securing a flexible, elongate member, such as a nylon cord, to one of the end apertures 32 or 48 and stringing the flexible elongate member back and forth through each of the apertures 32 and 48 to provide dividers as shown in FIG. 2. For example, a nylon cord could be attached to one of the end apertures 32 of bladder 12 with the other end of the cord strung through a corresponding end aperture 48 on flap 46, through an adjacent aperture 48 on flap 46 through an aperture 32 adjacent the end aperture 32 on bladder 12, and repeatedly stringing the cord in a similar manner through each of the apertures, alternating between pairs of adjacent apertures 32 and pairs of adjacent apertures 48. The ends of strap 24 can be permanently sewn or otherwise joined together after the strap has been looped through apertures 42 and strap loops 54, or strap 24 can be provided with a buckle or other fastening means which allows the length of the strap to be adjusted as desired. Alternatively, strap 24 can be attached directly to the bag such as by sewing an end or opposing ends of strap 24 to the fabric panel 14. Whether the strap is sewn or otherwise attached directly to the bag, or is strung through loops 54, it is desirable to connect each end of handle 20 to bag 10, as wing portion 36 generally cannot provide sufficient rigidity to allow a bag 10 carrying a significant amount of weight (e.g. a set of golf clubs) to be lifted by the handle unless the handle is also strapped or otherwise connected to the bag.

A sheath-like grip 58 can be disposed over grip portion 22 if desired to improve the feel of the grip and to enhance the appearance of the bag if desired.

Bladder 12 is provided with inflation means communicating with the interior of the bladder and having air-impermeable closure means for preventing communication with the interior of the bladder. Suitable inflation means, such as those used on inflatable toys, mattresses, and the like are well known and will not be described in further detail.

After the assembled bag has been inflated, the bottom and side walls of the bag formed by the bladder acquire a certain degree of rigidity. At the same time, the inflated bladder tends to exert tensile forces along the opposing lateral edges of the fabric panel 14. The resulting combination of forces exerted by a compressed gas within the bladder causes the bag to assume a relatively rigid structure which maintains its shape during use. Although the bag provides all the stiffness and rigidity needed, it is very light in weight, and is assembled from very few components. The total weight of the bag when empty is typically about 1 or 2 pounds. The club divider or dividers 26 also help hold the bag together and provide additional structural rigidity. In addition to providing sufficient rigidity, the inflated bladder also provides a cushioned support and enclosure for the golf clubs. Additionally, the bladder has sufficient thickness thereby elevating the bag above the ground to keep the heads of the clubs dry. Also, because the bladder is made of an air-impermeable material, it is also resistant to moisture. When inflated, the wing portion 36, including the grip portion 22 becomes sufficiently rigid so that grip portion 22 projects upwardly or forwardly from the bag so that a golfer may grab the grip portion and lift the bag from the ground without having to bend over and reach all the way down to the ground. The cushioning effect of the bladder also eliminates or reduces clanging sounds when the clubs are shifted within the bag.

The embodiments of the invention in which an exclusive property or privilege is claimed are defined as follows:

1. A lightweight golf bag comprising:

a flexible inflatable bladder having opposing lateral edges;

a fabric panel having opposing lateral edges, the opposing lateral edges of the fabric panel joined to the opposing lateral edges of the flexible inflatable bladder, the joined flexible inflatable bladder and fabric panel defining the golf bag, the golf bag being closed at one end and open at an opposing end, whereby golf clubs may be inserted into and removed from the golf bag through the open end, the golf bag having a bottom and sidewalls defined by the flexible inflatable bladder and a top defined by the fabric panel; and a plurality of golf club dividers located at the open end of the golf bag.

2. The bag of claim 1, wherein the bladder is comprised of two overlapping air-impermeable fabric sheets which are joined together near the periphery of the overlapping sheets to form an air-impermeable seam.

3. The bag of claim 2, wherein the air-impermeable fabric sheets are flexible and elastically stretchable.

4. The bag of claim 2, wherein the air-impermeable seam is formed by fusing the sheets together along the seam.

5. The bag of claim 1, wherein the bladder further includes wing portions which project laterally outwardly from the opposing lateral edges of the bladder and are connected together to form an integral handle.

6. The bag of claim 5, wherein the wing portions each include a first section which projects laterally outwardly from the bladder and a grip portion which extends at a substantially right angle from the end of the first section.

7. The bag of claim 6, wherein a free end of the handle is strapped to the bag.

8. The bag of claim 1, wherein the bladder includes a plurality of apertures along an upper edge thereof, and the fabric panel includes a flap having a plurality of apertures, each of which corresponds with one of the apertures located along the upper edge of the bladder, and wherein a cord is strung through the apertures on the flap and along the upper edge of the bladder to form the golf club dividers.

9. A lightweight golf bag comprising:

an outer bottom wall, opposing outer sidewalls and an outer top wall which define an elongate golf bag having first and second ends located at opposite extremities along the length thereof, the first end being closed and the opposing second end being open, whereby golf clubs may be inserted into and removed from the bag through the open end, at least one of the outer walls being defined by an inflatable bladder.

10. The bag of claim 9, wherein the bottom wall is defined by the inflatable bladder.

11. The bag of claim 9, wherein the bottom and side walls are defined by the inflatable bladder.

12. The bag of claim 9, wherein the inflatable bladder is comprised of two overlapping air-impermeable fabric sheets, each having a periphery the overlapping air-impermeable sheets being joined together near the peripheries thereof to form an air-impermeable seam, and wherein the air-impermeable fabric sheets are flexible and elastically stretchable.

13. The bag of claim 9, wherein the bladder further includes wing portions which project laterally outwardly from opposing lateral edges of the bladder and are connected together to form an integral handle.

14. A lightweight golf bag comprising:

a flexible inflatable bladder having opposing lateral edges; and a fabric panel having opposing lateral edges, the opposing lateral edges of the fabric panel joined to the opposing lateral edges of the flexible inflatable bladder, the distance between the opposing lateral edges of the flexible inflatable bladder being greater than the distance between the opposing lateral edges of the fabric panel, whereby bottom and side walls of the golf bag are defined by the flexible inflatable bladder and a top wall of the golf bag is defined by the fabric panel.

15. The bag of claim 14, wherein the bladder is comprised of two overlapping air-impermeable fabric sheets which are joined together near the periphery of the overlapping sheets to form an air-impermeable seam, and wherein the air-impermeable fabric sheets are flexible and elastically stretchable.

16. The bag of claim 15, wherein the flexible inflatable bladder includes wing portions which project laterally outwardly from the opposing lateral edges of the bladder and are connected together to form an integral handle.

17. The bag of claim 16, wherein the golf bag is closed at one end and open at an opposing end, whereby golf clubs may be inserted into and removed from the bag through the open end, and wherein a plurality of golf club dividers are provided at the open end of the golf bag.

18. The bag of claim 17, wherein the flexible inflatable bladder includes a plurality of apertures along an upper edge thereof, and the fabric panel includes a flap having a plurality of apertures, each of which corresponds with one of the apertures located along the upper edge of the flexible inflatable bladder, and wherein a cord is strung through the apertures on the flap and along the upper edge of the bladder to form the plurality of golf club dividers.

* * * * *